US005103994A

United States Patent [19]

Doxey et al.

[11] Patent Number: 5,103,994

[45] Date of Patent: Apr. 14, 1992

[54] LOCKING SYSTEM FOR A WASTE RECEPTACLE

[75] Inventors: André G. Doxey, Shaker Heights; John L. Hradisky, Medina, both of Ohio

[73] Assignee: Rubbermaid Incorporated, Wooster, Ohio

[21] Appl. No.: 635,347

[22] Filed: Dec. 28, 1990

[51] Int. Cl.[5] ..... B65D 45/16

[52] U.S. Cl. ..... 220/324; 220/318; 220/908; 220/340

[58] Field of Search ..... 220/318, 908, 337, 338, 220/908, 340, 324

[56] References Cited

U.S. PATENT DOCUMENTS

| | | | |
|---|---|---|---|
| 3,576,271 | 4/1971 | Seeley | 220/337 |
| 3,860,141 | 1/1975 | Hawk | 220/908 X |
| 4,099,648 | 7/1978 | Kirkton | 220/340 |
| 4,390,110 | 6/1983 | Pirro | 220/908 X |
| 4,691,840 | 9/1987 | Ferbrache | 220/318 |
| 4,819,827 | 4/1989 | DiSesa | 220/318 |

*Primary Examiner*—Stephen Marcus
*Assistant Examiner*—Paul A. Schwarz
*Attorney, Agent, or Firm*—Renner, Kenner, Greive, Bobak, Taylor & Weber

[57] ABSTRACT

A waste receptacle (10) includes a base container portion (12) having an open top (24) defined by an upper lip (39) and a cover (11) for closing the open top (24) of the base container portion (12). The cover (11) has a downturned flange (16) having an outer peripheral groove (17) therein which forms an inner lug (18). A locking handle assembly (30) is pivotally attached to the rear wall (21) of the base container portion (12). A hook member (40) is formed on the lip (39) on the top of the front wall (20) of the base container portion (12) to form a recess (44) therebelow. The lug (18) of cover (11) is received in the recess (44). The handle assembly (30) includes lobe projections (36) which are received in the groove (17) when the handle assembly (30) is rotated toward the base container portion (12) at which time the locking tooth projections (38) engage the rear wall (21) of the base container (12) to lock the cover (11) in place.

17 Claims, 3 Drawing Sheets

LOCKING SYSTEM FOR A WASTE RECEPTACLE

TECHNICAL FIELD

This invention relates to a waste receptacle or refuse container having a unique system for locking the container cover to the base. More particularly, this invention relates to a locking system which utilizes a single handle to secure and lock the cover to the base.

BACKGROUND ART

Many waste receptacles or refuse containers which are provided with covers are also provided with a means to temporarily lock or affix the cover to the base of the container. Such containers are also quite often provided with handles so that they may be readily transported from place to place. In such situations, in the past it has been found convenient to design the handles so that they also play a role in the locking of the lid to the container. Such a system is shown in U.S. Pat. No. 4,691,840.

In that patent, two handles are provided on diametrically opposed sides of a cylindrical container. Through a pivotal camming action of both handles, the lid is locked onto the container base. However, in order for this design to insure complete locking and to enable the user to easily transport the container, the use of two handles is desirable if not mandatory. If only one handle were utilized on one side of the container, the user could disengage the cover by grasping the cover on the side opposite to the handle and manually lift the cover to override the lock on the other side. Moreover, the need for two handles not only increases the cost of the product, but also the time to assemble the product is likewise increased.

DISCLOSURE OF THE INVENTION

It is thus a primary object of the present invention to provide a waste receptacle with a simple means of securing a cover to a base component thereof.

It is another object of the present invention to provide a waste receptacle, as above, in which only a single handle is utilized to perform the function of securing the cover to the base.

It is a further object of the present invention to provide a waste receptacle, as above, which is easy to assemble and inexpensive to manufacture.

It is an additional object of the present invention to provide a waste receptacle, as above, which is generally rectangular in a top plan view and in which the cover is symmetrically configured so that it may be positioned on the base portion of the receptacle in multiple directions.

These and other objects of the present invention, as well as the advantages thereof over existing prior art forms, which will become apparent from the description to follow, are accomplished by the means hereinafter described and claimed.

In general, a waste receptacle includes a base container portion having generally vertical walls with an upper lip at the top thereof forming an open top. A cover is provided for closing the open top and includes a lug formed thereon. A hook member is formed on the lip of one of the walls of the base container portion and defines a recess therebelow. The lug of the cover is received in the recess when the cover is positioned on the base container portion. A locking handle is pivotally connected to a wall of the base container portion opposite to the wall which has the hook member on the lip such that when the handle is pivoted toward the base container portion, the cover lug is maintained in the recess.

A preferred exemplary waste receptacle incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
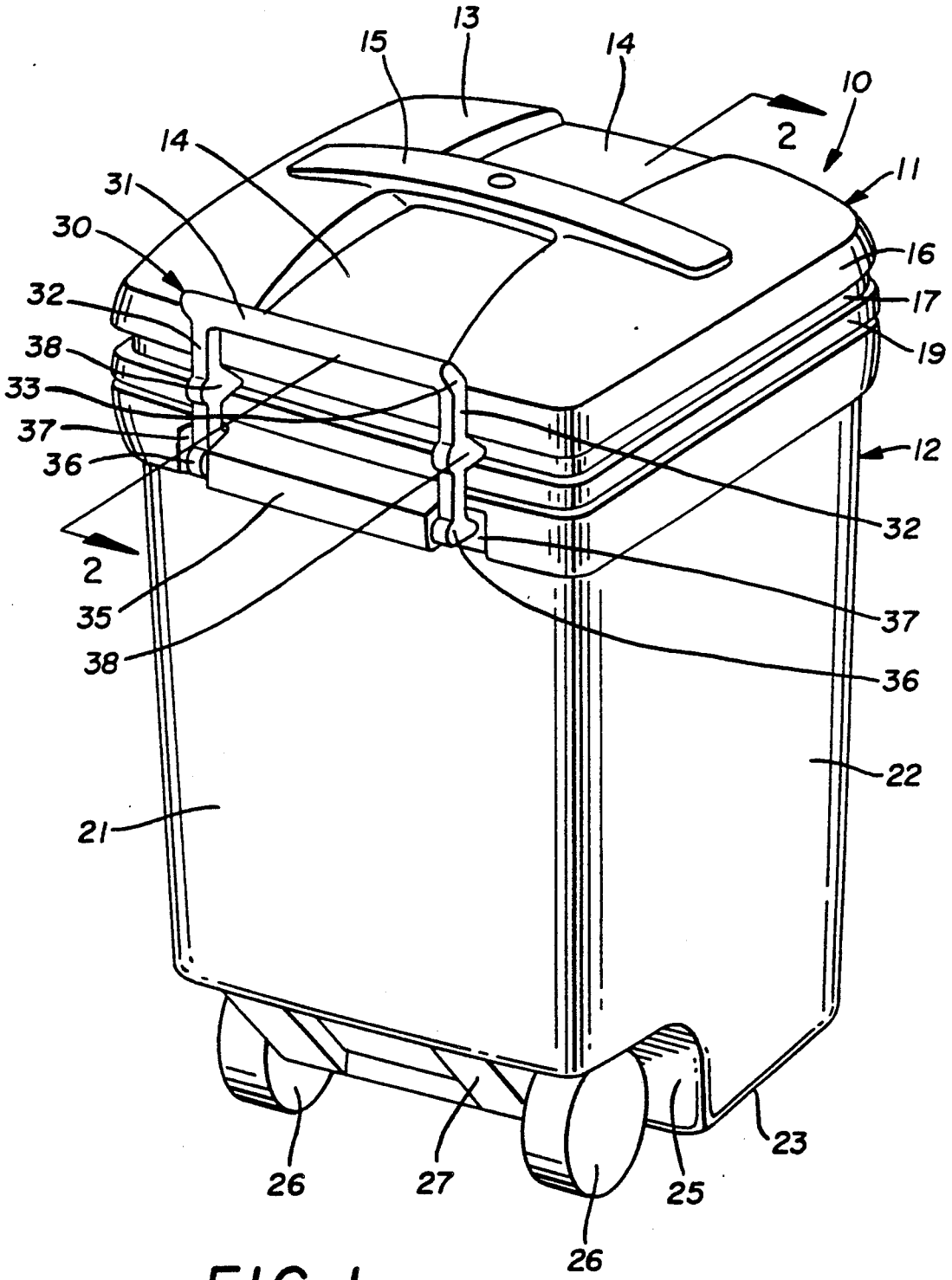
FIG. 1 is a rear and side perspective view of a waste receptacle made in accordance with the concepts of the present invention.

A waste receptacle is generally indicated by the numeral 10 in FIG. 1 and is shown as including a cover, generally indicated by the numeral 11, and a base container portion generally indicated by the numeral 12. Both cover 11 and base portion 12 are preferably made of a somewhat resilient plastic material and are shown as being generally rectangular in plan view although this invention is not limited to a rectangular or square container. Cover 11 is also shown as including a slightly domed top 13 having cutout recesses 14 formed therein. A cover handle 15 extends in a generally transverse direction to, and otherwise spans, recesses 14 so that the cover 11 may be easily transported when detached from base portion 12.

Cover 11 is also provided with a downturned flange 16 at the periphery of domed top 13, and a peripheral groove 17 at the lower end of flange 16. As will hereinafter be described in more detail, internally, peripheral groove 17 forms an inner lug 18. Groove 17 terminates at its lower end as a downturned peripheral skirt 19 which is generally aligned with flange 16 to form a rather uniform outer periphery of cover 11 interrupted only by groove 17.

Base portion 12 of receptacle 10 is shown, as previously indicated, as being generally rectangular in nature having a generally vertical front wall 20, a generally vertical rear wall 21, and two generally vertical side walls 22 integrally formed with front wall 20 and rear wall 21. Walls 20, 21 and 22 all extend upwardly from a bottom surface 23 to form a container with an open top 24 to hold refuse or the like. A wheel well recess 25 is formed at the bottom of rear wall 21 to confine wheels 26 therein which are rotatably mounted on a supporting hub 27 in a conventional manner. As such, and as will hereinafter become evident, receptacle 10 can be tilted back on wheels 26 and conveniently transported over the ground.

Base portion 12 is also provided with a handle assembly indicated generally by the numeral 30 and located near the top of rear wall 21. Handle assembly 30 can be basically identical in structure, and in particular in function, to one of the handle assemblies disclosed in U.S. Pat. No. 4,691,840 and therefore reference is made to that patent for whatever details may be necessary to totally understand the construction and operation of handle assembly 30.

As disclosed in U.S. Pat. No. 4,691,840 and as shown herein, handle assembly 30 is of a generally U-shaped configuration including a bight portion 31 having elongate arms 32 extending therefrom. Arms 32 join bight portion 31 by way of small intermediate arm segments 33 which are offset from the plane of arms 32 such that the bight portion 31 lies in a plane outwardly of arms 32. As such, the user may readily grasp bight portion 31 to transport waste receptacle 10 from one location to another on wheels 26.

In a manner described in U.S. Pat. No. 4,691,840, the lower end of each arm 32 is pivoted, as at 34, to a mounting boss 35 which extends outwardly from rear wall 21. The lower end of each arm 32 is also provided with an inwardly directed camming lobe projection 36. Projections 36 face rear wall 21 in general alignment with recesses 37 formed therein. Each arm 32 is also provided with a cover locking tooth projection 38 formed generally medially on each arm 32.

Figure 2:
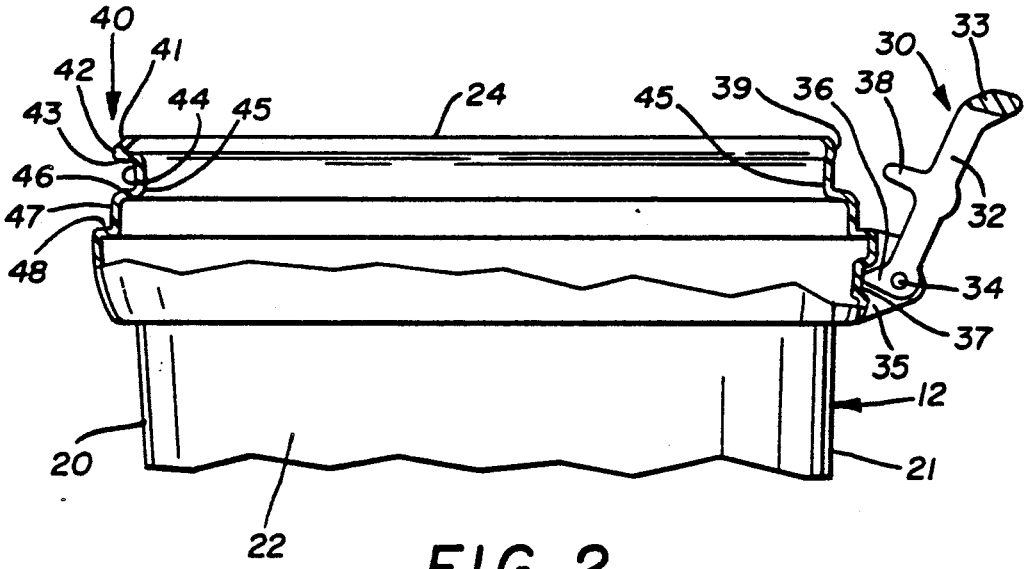
FIG. 2 is a fragmented sectional view taken substantially along line 2—2 of FIG. 1 showing the sectional profile of the base of the receptacle without the cover.

The configuration of the external upper periphery of base portion 12 of receptacle 10 is best shown, for example, in FIG. 2. Open top 24 is generally defined by an arcuate lip 39 formed at the top of rear wall 21, side walls 22 ad the majority of front wall 20. However, at the location in front wall 20 generally directly opposite handle assembly 30, the lip is formed as a wedge-shaped hook member generally indicated by the numeral 40. Hook member 40 includes a sloped surface 41 extending outwardly to a tip portion 42. A generally horizontal surface 43 extends from tip portion inwardly to form a recess 44, the inner extent of which is defined by upper skirt 45. As shown, upper skirt 45 extends around the entire outer periphery of base portion 12, that is, below the arcuate lip 39 and below hook member 40. But because the tip 42 of hook member 40 extends outwardly further than arcuate lip 39, at only that location is recess 44 formed.

Figure 4:
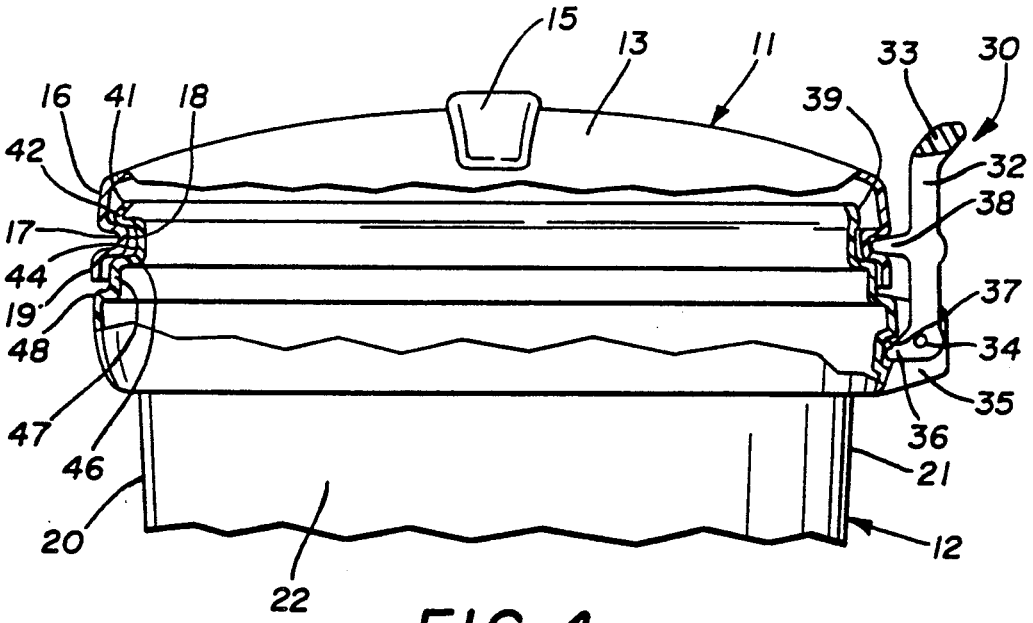
FIG. 4 is a fragmented sectional view taken at the same location as FIG. 2 but showing the cover positioned on and locked to the base portion of the receptacle.

The lower portion of upper skirt 45 terminates as an outwardly extending upper ledge 46 upon which, as shown in FIG. 4, the peripheral groove 17 of cover 11 rests when in the closed position. At the location of hook member 40, upper ledge 46 also forms the bottom of recess 44 of base portion 12. The outer periphery of ledge 46 then turns downwardly to form a lower skirt 47 in walls 20, 21, and 22 which at its lower end turns outwardly to form a lower ledge 48 above which peripheral skirt 19 of cover 11 is located when waste receptacle 10 is closed.

Figure 3:
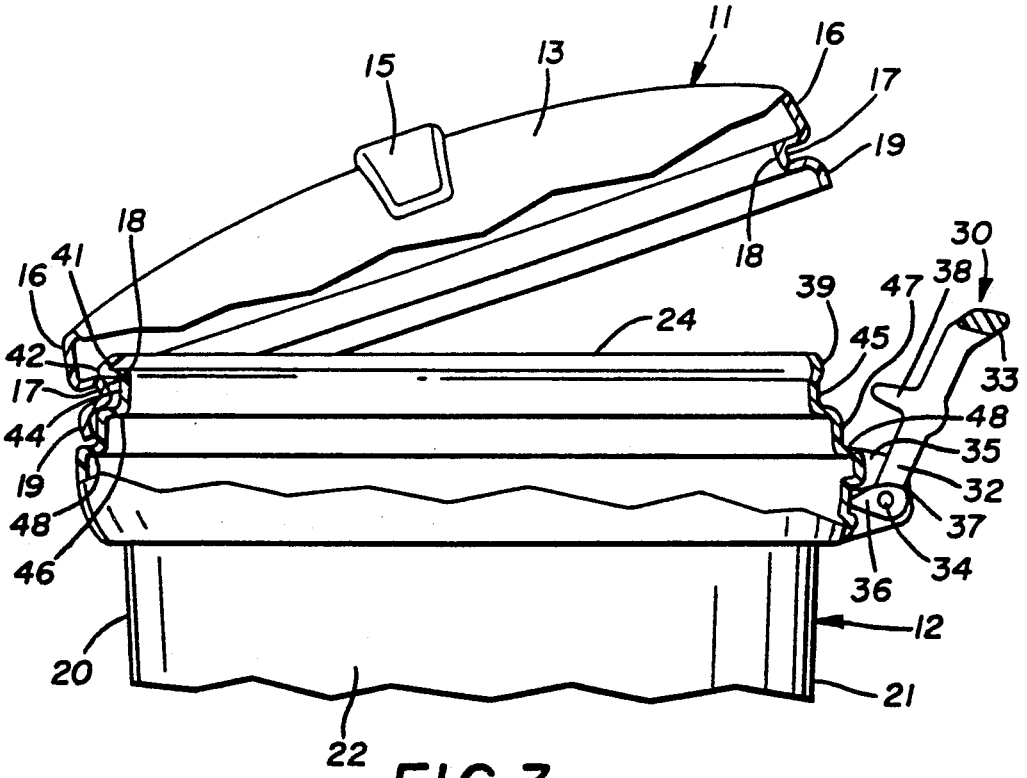
FIG. 3 is a somewhat schematic fragmented elevational view of the receptacle showing the manner in which the cover is positioned on the base portion.

In order to position and lock cover 11 on base portion 12, cover 11 is first oriented in one of two positions (if receptacle 10 is rectangular) or in one of four positions (if receptacle 10 is square) such that lug 18 of peripheral groove 17 of cover 11 is resting on sloped surface 41 of hook member 40 of base portion 12. Downward pressure, which can result even under the influence of gravity, positions groove 17 and lug member 18 generally within recess 44 as shown in FIG. 3. Then with handle assembly 30 rotated to a position away from receptacle 10, as shown in FIG. 3, rotation of cover 11 (clockwise in FIG. 3) positions cover 11 squarely on base portion 12. At this point in time, handle assembly may be rotated, counterclockwise from the FIG. 3 to the FIG. 4 position. During such rotation, camming lobe projections 36 impress against recesses 37 as tooth projections 38 enter into groove 17 of cover 11. In the upright, locked, FIG. 4 position, camming lobe projections 36 have deformed recesses 37 inwardly such that latent resilient forces with the elastomeric base portion 12 exert an outward force on projections 36 to resist any inadvertent or unintended pivotal movement of handle assembly 30 out of its locking relationship. Of course, at the same time lug 18 on cover 11 is held inwardly engaged within recess 44 such that cover 11 cannot be disengaged from base portion 12 without releasing handle assembly 30. Such release, however, can be readily accomplished by rotating the handle assembly clockwise (FIG. 4) overcoming the frictional lock between base portion 12 and camming projections 36.

It should thus be evident that a waste receptacle constructed with the locking system according to the concepts of the present invention accomplishes the objects of the present invention and otherwise substantially improves the art.

What is claimed is:

1. A receptacle comprising a base container portion having generally vertical walls with an upper lip forming an open top, a cover which can be oriented in more than one rotational position relative to said base container portion to close said open top, hook means formed on said lip on only one of the walls of said base container portion thereby forming a recess in only said one wall therebelow, lug means extending around the periphery of said cover to engage said recess, and locking handle means pivotally attached to another wall of said base container portion opposite to said one wall and engaging said cover only on the side opposite to where said lug means are in said recess to maintain said lug means in said recess.

2. A receptacle according to claim 1 further comprising a downturned peripheral flange on said cover, and a groove in said flange, said locking handle means engaging said groove.

3. A receptacle according to claim 2 wherein said groove forms said lug means.

4. A receptacle according to claim 2 wherein said locking handle means includes a projection received in said groove when said handle means is engaging said cover.

5. A receptacle according to claim 4 wherein said locking handle means includes an additional projection engaging said another wall of said base container portion when said handle means is engaging said cover.

6. A receptacle according to claim 1 wherein said hook means includes a sloped surface extending outwardly to a tip portion, said recess being below said sloped surface and inward of said tip portion.

7. A receptacle according to claim 1 further comprising a handle on the top of said cover.

8. A receptacle according to claim 1 further comprising wheels rotatably carried at the bottom of said another wall of said base container portion thereby rendering the receptacle readily transportable when the receptacle is grasped by said handle means and tilted onto said wheels.

9. A receptacle comprising a base container portion having an upper lip forming an open top, a cover for closing said open top, said cover having a downturned flange with a groove in the outer periphery thereof forming an inner peripheral lug, a locking handle pivotally attached to said base container portion on one side thereof, said locking handle thereby being movable toward said cover to lock said cover onto said base container portion and movable away from said cover to release the same, hook means formed on said lip on a side of said base container portion opposite said locking handle to form a recess only in said side of said base container portion opposite said locking handle, said cover being positionable in more than one rotational position relative to said base container portion so that a portion of said peripheral lug is received in said recess, and a projection on said locking handle received in said groove when said locking handle is moved toward said cover.

10. A receptacle according to claim 9 further comprising an additional projection on said locking handle for engaging said one side of said base container portion when said locking handle is moved toward said cover.

11. A receptacle according to claim 10 wherein said locking handle is U-shaped having two arms spanned by a bight portion, there being two said projections, one on each arm, and two said additional projections, one on each arm.

12. A receptacle according to claim 11 wherein said bight portion of said locking handle is offset from said arms.

13. A receptacle according to claim 9 wherein said base container portion is rectangular in configuration having four generally vertical walls with pairs of said walls being generally parallel to each other, one of said pairs of walls including said one side carrying said locking handle and said side opposite said locking handle where said hook means are formed on said lip.

14. A receptacle according to claim 9 wherein said hook means includes a sloped surface extending outwardly to a tip portion, said recess being below said sloped surface and inward of said tip portion.

15. A receptacle according to claim 9 further comprising a handle on the top of said cover.

16. A receptacle according to claim 9 further comprising wheels rotatably carried near the bottom on said one side of said base container portion thereby rendering the receptacle readily transportable when the receptacle is grasped by said locking handle and tilted onto said wheels.

17. A receptacle comprising a base container portion having generally vertical walls with an upper lip forming an open top, a cover for closing said open top, hook means formed on said lip on one of the walls of said base container portion thereby forming a recess in said one of said walls therebelow, said hook means including a sloped surface extending outwardly to a tip portion, said recess being below said sloped surface and inward of said tip portion, lug means extending around the periphery of said cover, said cover being capable of being oriented in more than one rotational position relative to said base container portion such that a portion of said lug means is adapted first to be positioned on said sloped surface and then to be positioned in said recess, and locking handle means pivotally attached to another wall of said base container portion opposite to said one of said walls to engage said cover and lock said lug means in said recess.

* * * * *

UNITED STATES PATENT AND TRADEMARK OFFICE

CERTIFICATE OF CORRECTION

PATENT NO. : 5,103,994

DATED : April 14, 1992

INVENTOR(S) : Andre G. Doxey and John L. Hradisky

It is certified that error appears in the above-identified patent and that said Letters Patent is hereby corrected as shown below:

Column 3, line 33, "ad" should read --and--.

Column 5, line 7, following "lip" insert --only--;
following "on" delete "a" and insert --the--.

Signed and Sealed this

Sixteenth Day of November, 1993

*Attest:*

*Attesting Officer*

BRUCE LEHMAN

*Commissioner of Patents and Trademarks*